US007401907B2

(12) United States Patent
Perez

(10) Patent No.: US 7,401,907 B2
(45) Date of Patent: Jul. 22, 2008

(54) IMAGING DEVICE INCLUDING A PASSIVE VALVE

(75) Inventor: Raul Perez, San Marcos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 160 days.

(21) Appl. No.: 11/040,667

(22) Filed: Jan. 21, 2005

(65) Prior Publication Data

US 2006/0164472 A1 Jul. 27, 2006

(51) Int. Cl.
*B41J 2/175* (2006.01)
*B41J 2/18* (2006.01)

(52) U.S. Cl. ..... 347/84; 347/89

(58) Field of Classification Search ..... 347/7, 347/85, 86, 87; 141/2, 18
See application file for complete search history.

(56) References Cited

U.S. PATENT DOCUMENTS 3,961,337 A 6/1976 Jung et al.
4,023,491 A 5/1977 Kirby, Jr.
4,514,742 A * 4/1985 Suga et al. ..... 347/85
4,527,175 A * 7/1985 Kojima et al. ..... 347/85
4,680,696 A * 7/1987 Ebinuma et al. ..... 347/85
4,882,596 A 11/1989 Tsuzuki et al.
5,231,424 A * 7/1993 Kaneko et al. ..... 347/29
5,485,187 A * 1/1996 Okamura et al. ..... 347/85
5,719,608 A 2/1998 Sabonis et al.
6,050,680 A 4/2000 Moariyama et al.
6,059,405 A * 5/2000 Mochizuki et al. ..... 347/92
6,151,039 A * 11/2000 Hmelar et al. ..... 347/7
6,206,511 B1 * 3/2001 Cook et al. ..... 347/85
6,860,591 B2 * 3/2005 Slotto et al. ..... 347/85
6,883,905 B2 * 4/2005 Kimura et al. ..... 347/85
7,128,404 B2 * 10/2006 Kodama ..... 347/68

FOREIGN PATENT DOCUMENTS

EP 0823329 A 2/1998

OTHER PUBLICATIONS

International Search Report for Application No. PCT/US2006/002081. Report issued May 29, 2006.

* cited by examiner

*Primary Examiner*—Anh T. N. Vo

(57) ABSTRACT

One embodiment of an imaging device includes a first imaging fluid reservoir connected to a first passive valve, a second imaging fluid reservoir connected to a second passive valve, and a pumping system operatively connected to the first and second imaging fluid reservoirs for selectively flowing imaging fluid from each of the first and second imaging fluid reservoirs.

19 Claims, 2 Drawing Sheets

IMAGING DEVICE INCLUDING A PASSIVE VALVE

BACKGROUND

Imaging devices, such as printers, may utilize an imaging fluid, such as ink, from an ink cartridge during use. As the ink is depleted from the ink cartridge, it may be desirable to continue printing without interruption. Accordingly, a second ink cartridge may be employed. Sensors may be utilized to determine when the first ink cartridge is empty or nearly empty. An active valve, such as a manual valve, a pneumatic valve, or solenoid valve, may then be used to isolate the ink cartridge to be removed. These active valves may require an external input, such as manual manipulation by an operator, an air pressure source or a voltage source, for operation. They may also require additional circuitry and/or software for operation, may have moving parts that degrade over time, and may provide a small flow path for fluid flow. These active valves may also be expensive to purchase and install in an imaging device. Accordingly, it may be desirable to provide a passive, inexpensive method of isolating an ink cartridge to be removed from an imaging device so that the ink cartridge may be removed, refilled and reinstalled in the imaging device without an interruption of printing with ink from another ink cartridge.

DETAILED DESCRIPTION OF THE DRAWINGS

Figure 1:
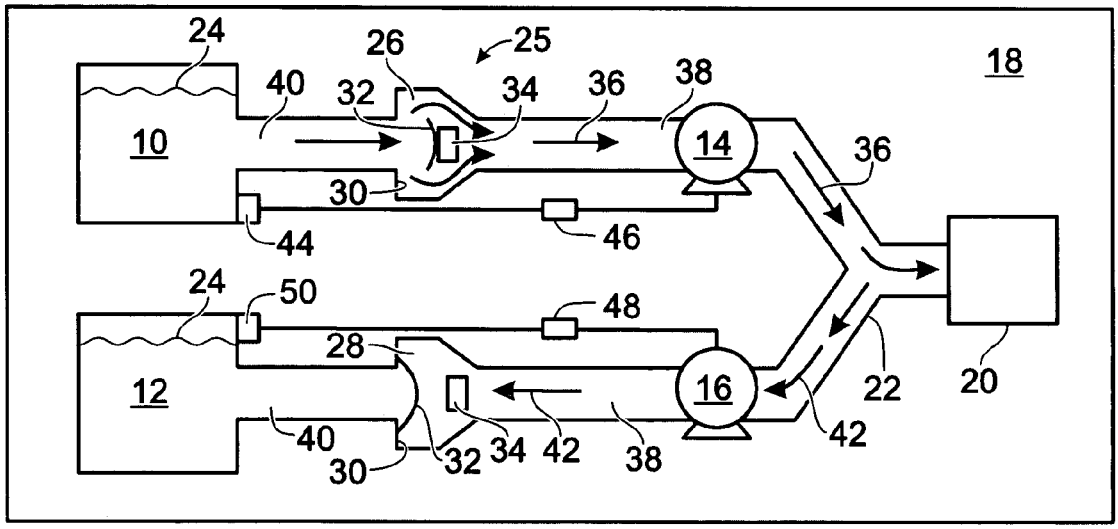
FIG. 1 is a schematic flow diagram of two ink reservoirs and two pumps in an exemplary embodiment of an imaging device.

FIG. 1 is a schematic flow diagram of two imaging fluid reservoirs, such as ink reservoirs 10 and 12, and two pumps 14 and 16 in an imaging device 18. Imaging device 18 may comprise a printer, such as an inkjet printer, including a printhead 20 for printing an image (not shown). Imaging device 18 may further include a Y-connection 22 that connects printhead 20 to each of ink reservoirs 10 and 12. Y-connection 22 may allow the imaging device to print using ink from either of ink reservoirs 10 or 12.

Ink reservoirs 10 and 12 may each comprise an ink supply containing ink 24 therein. Ink 24 may comprise any type of imaging fluid utilized to print an image from printhead 20 of imaging device 18. Pumps 14 and 16 may comprise any type of pump such as a gear pump, a rotating pump, a peristaltic pump, an air pressure pump utilized to compress a flexible ink reservoir, or a mechanical spring, such as a spring-loaded plate, utilized to compress a flexible ink reservoir, or the like. Accordingly, pumps 14 and 16 may be positioned in any location within imaging device 18 so as to effect movement of ink 24 from ink reservoirs 10 and 12 to printhead 20. Moreover, pumps 14 and 16 may each be described as any device that causes ink 24, either directly or indirectly, to move out of an ink reservoir. In the embodiment shown in FIG. 1, pumps 14 and 16 each comprise a rotating pump.

Imaging device 18 further comprises an ink flow control system 25 that may include first and second passive valves 26 and 28 associated, respectively, with each of reservoirs 10 and 12. In the embodiment shown, passive valves 26 and 28 are each check valves including a port 30, a movable diaphragm 32 and a stop surface 34. Check valve 26 is shown in an open position and check valve 28 is shown in a closed position. Value 28 may function in the same manner as valve 26. Accordingly, the operation of valve 26 will be described.

In operation, check valve 26 may allow fluid flow in a single flow direction 36. In general, fluid will attempt to flow from a region of high pressure to a region of low pressure. When a pressure downstream 38 of check valve 26 is lower than a pressure upstream 40, diaphragm 32, which may be a flexible membrane, will be moved by the fluid toward stop surface 34 thereby opening check valve 26. Fluid, such as ink 24, may then flow around diaphragm 32 and stop surface 34 to the downstream region 38 of lower pressure.

When a pressure downstream 38 of the check valve is higher than a pressure upstream 40, diaphragm 32, will be moved by the fluid toward and into sealing engagement with port 30 (as shown by closed position of valve 28 in FIG. 1), thereby closing the heck valve. Fluid, such as ink 24, may then be hindered or prevented from flowing through the check valve toward upstream region 40. Check valves 26 and 28, therefore, may be referred to as one-way flow valves.

Each of the check valves may also be referred to as a passive valve because the pressure conditions within the system, which may be continually varying, may move the valve between the open and closed positions without manual intervention by an operator. Check valves are generally simpler and less expensive to manufacture than active valves, are more reliable due to their mechanical simplicity, and generally do not utilize additional control electronics to operate. These advantages allow for a flow control system that is inexpensive, reliable and self-operating.

Still referring to FIG. 1, operation of one embodiment of imaging device 18 will be described. Pumps 14 and 16 may be operated in conjunction with check valves 26 and 28 to allow imaging device 18 to print utilizing one ink reservoir while the other ink reservoir is removed, refilled and reinstalled into the imaging device. In one embodiment of operation, pump 16 may be operated in reverse to force ink 24 to flow in an upstream direction 42 toward check valve 28, thereby closing check valve 28 and isolating second reservoir 12 from printhead 20 and first reservoir 10. As long as pump 16 is operated in the reverse direction, check valve 28 may remain closed. This will allow second ink reservoir 12 to be removed from imaging device 18, to be refilled with ink, and then reinstalled into imaging device 18 and into fluid communication with printhead 20. Pump 16 may remain operating in a reserve direction such that printhead 20 will continue to print with ink depleted solely from first ink reservoir 10, while reservoir 12 is removed.

The ink from first ink reservoir 10 may flow to printhead 20 by the operation of pump 14 in a forward direction. When ink reservoir 10 is empty, or near empty, which may be indicated by a sensor 44 on ink reservoir 10 to a controller 46, pump 14 may then be operated in a reverse direction by controller 46. This may cause ink 24 to flow in an upstream direction toward first check valve 26 which will close check valve 26, thereby isolating ink reservoir 10 from ink reservoir 12 and printhead 20. A controller 48 may then operate pump 16 in a forward direction, which may cause ink 24 to flow in a downstream direction from second ink reservoir 12, thereby opening check valve 28. First ink reservoir 10 may then be removed from imaging device 18, be refilled with ink, and then reinstalled into imaging device 18 and into fluid communication with printhead 20. Pump 14 may remain operating in a reserve direction such that printhead 20 will continue to print with ink depleted solely from second ink reservoir 12. When a sensor 50 on second ink reservoir 12 detects that ink reservoir 12 is empty or near empty, the process may be repeated with second ink reservoir 12 isolated from the system, and ink withdrawn from first reservoir 10 for imaging by printhead 20.

Because imaging device 18 may continue to print during removal of one of the ink reservoirs, the imaging device may print for an indefinite amount of time. Accordingly, imaging device 18 may be referred to as having a redundant or an indefinite ink supply because when one ink reservoir is depleted the imaging device can print with ink from the other reservoir, provided the ink reservoirs are continuously replaced or refilled as they become empty.

In another embodiment, imaging device 18 may include three or more ink reservoirs, each associated with a check valve, a pump, a sensor and a controller. In another embodiment, one controller may control each of the pumps. In still another embodiment, the ink cartridge that is removed may not be refilled but may be replaced in imaging device 18 by a new, filled ink cartridge, wherein the old depleted ink cartridge may be discarded.

Still referring to FIG. 1, in another embodiment of operation, pump 14 may be operated in a forward direction to pump ink from first reservoir 10. Pump 16 may remain inactive. The operation of pump 14 will cause ink to flow in an upstream direction 42 toward check valve 28, thereby closing that check valve. Second ink reservoir 12, therefore, is isolated from first reservoir 10 and printhead 20 so that second ink reservoir 12 may be removed, refilled and reinstalled without an interruption of printing by printhead 20. Similarly, pump 16 may be operated in a forward direction to pump ink from second reservoir 12. Pump 14 may remain inactive. The operation of pump 16 will cause ink to flow in an upstream direction toward check valve 26, thereby closing that check valve. First ink reservoir 10, therefore, is isolated from second reservoir 12 and printhead 20 so that first ink reservoir 10 may be removed, refilled and reinstalled without an interruption of printing by printhead 20. This method of operation does not utilize a reverse direction of pumping action and, therefore, may allow a wide variety of pumps to be utilized.

Figure 2:
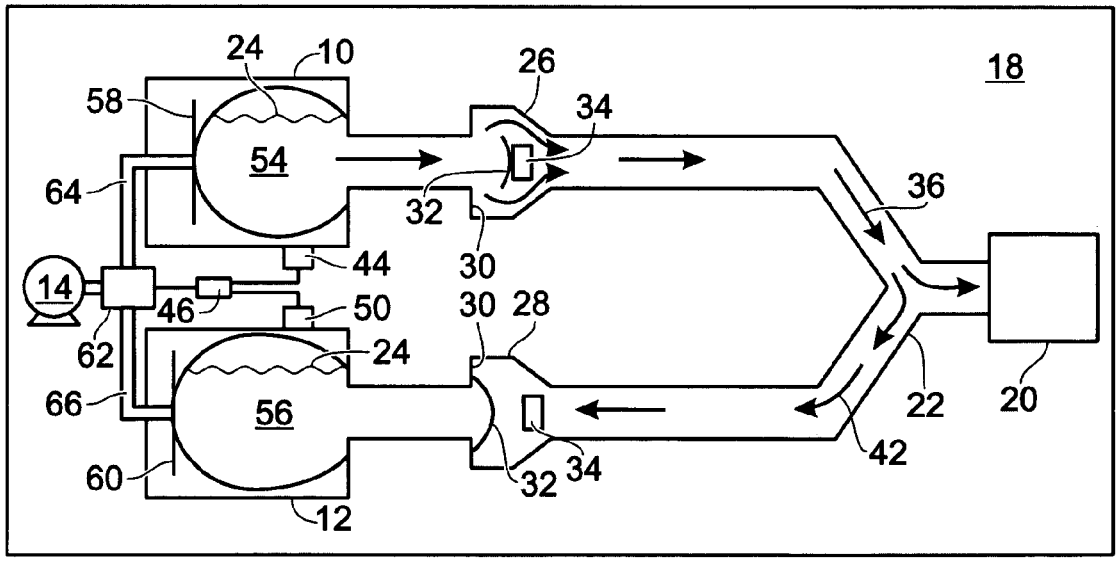
FIG. 2 is a schematic flow diagram of two ink reservoirs and a single pump in an exemplary embodiment of an imaging device.

FIG. 2 is a schematic diagram of another embodiment of imaging device 18 including two ink reservoirs 10 and 12 and a single pump 14. Pump 14 may comprise an air compressor that may be operatively connected to each of ink reservoirs 10 and 12. Each of the ink reservoirs 10 and 12 may include a flexible bag 54 and 56, respectively, filled with imaging fluid, such as ink 24. Each reservoir may also include a plate 58 and 60, respectively, movably positioned against flexible bags 54 and 56, and connected to a manifold 62 via air pressure lines 64 and 66, respectively. Manifold 62 may be connected to pump 14. Manifold 62 may be controlled by a controller 46 that may be connected to sensors 44 and 50, respectively, on ink reservoirs 10 and 12. Controller 46 may operate manifold 62 so as to allow pump 14 to selectively pressurize one of plates 58 or 60 to compress ink from one of flexible bags 54 or 56, respectively, in response to a reading by sensor 44 and/or 50.

Operation of the embodiment of FIG. 2 will now be described. Sensor 50 may indicate to controller 46 that second flexible bag 56 of second ink reservoir 12 is empty. Controller 46 may then operate manifold 62 to activate pump 14 and to open air pressure line 64 to plate 58 in first ink reservoir 10. The air pressure on plate 58 may cause the plate to compress bag 54 thereby causing ink to flow in downstream direction 36, through open first check valve 26, and toward printhead 20. This flow will also be directed around Y-connection 22 in upstream direction 42 toward second check valve 28, thereby closing second check valve 28. Bag 56 of second ink reservoir 12, accordingly, is isolated by closed check valve 28 from printhead 20 and first ink reservoir 10. The second ink reservoir 12 may then be removed, refilled, and reinstalled within imaging device 18 while printhead 20 continuously prints without interruption or loss of pressure.

When first bag 54 is empty or near empty, sensor 44 may indicate such a condition to controller 46. Controller 46 may then operate manifold 62 to activate pump 14 and to open air pressure line 66 to plate 60 in second ink reservoir 12. The air pressure on plate 60 may cause the plate to compress bag 56 thereby causing ink to flow in downstream direction 36, through open second check valve 28, and toward printhead 20. This flow will also be directly around Y-connection 22 in an upstream direction toward first check valve 26, thereby closing first check valve 26. Bag 58 of first ink reservoir 10, accordingly, is isolated by closed check valve 26 from printhead 20 and second ink reservoir 12. The first ink reservoir 10 may then be removed, refilled, and reinstalled within imaging device 18 while printhead 20 continuously prints without interruption or loss of pressure.

In another embodiment, imaging device 18 may include three or more ink reservoirs, each associated with a check valve, a single pump, a sensor and a controller. The pump may be connected to the three or more ink reservoirs by a corresponding air pressure line wherein one or more of the reservoirs may be simultaneously pressurized, thereby closing the check valves to the non-pressurized reservoirs.

Figure 3A:
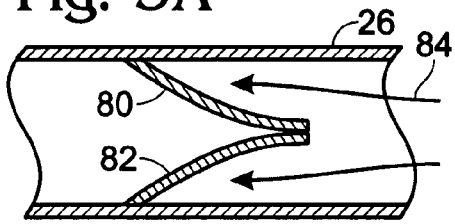
FIGS. 3A and 3B are schematic views of an exemplary embodiment of a passive valve in the closed and open positions, respectively.
Figure 3B:
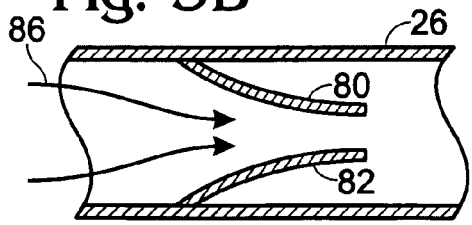

FIGS. 3A and 3B are schematic views of another embodiment of a passive valve 26 in the closed and open positions, respectively. In this embodiment, valve 26 includes two flexible "duck bills" 80 and 82 that close under pressure from a backward flow 84 (FIG. 3A) and open in response to a forward flow 86 (FIG. 3B).

Figure 4A:
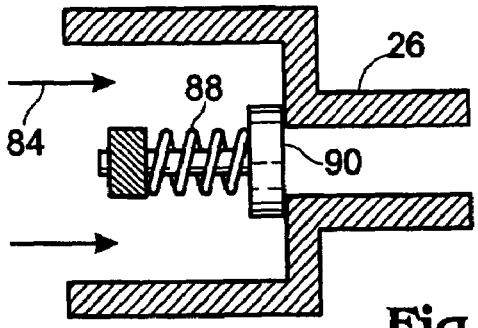
FIGS. 4A and 4B are schematic views of another exemplary embodiment of a passive valve in the closed and open positions, respectively.
Figure 4B:
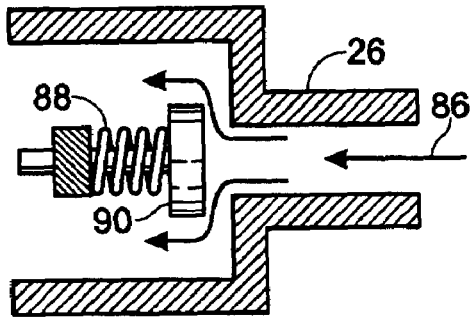

FIGS. 4A and 4B are schematic views of another embodiment of a passive valve 26 in the closed and open positions, respectively. In this embodiment, valve 26 includes a spring 88 loaded plunger 90 that closes under pressure from a backward flow 84 (FIG. 4A) and opens in response to a forward flow 86 (FIG. 4B).

Figure 5A:
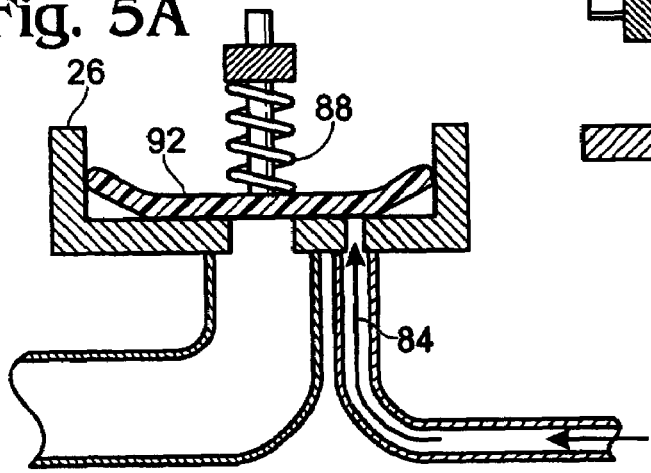
FIGS. 5A and 5B are schematic views of yet another exemplary embodiment of a passive valve in the closed and open positions, respectively.
Figure 5B:
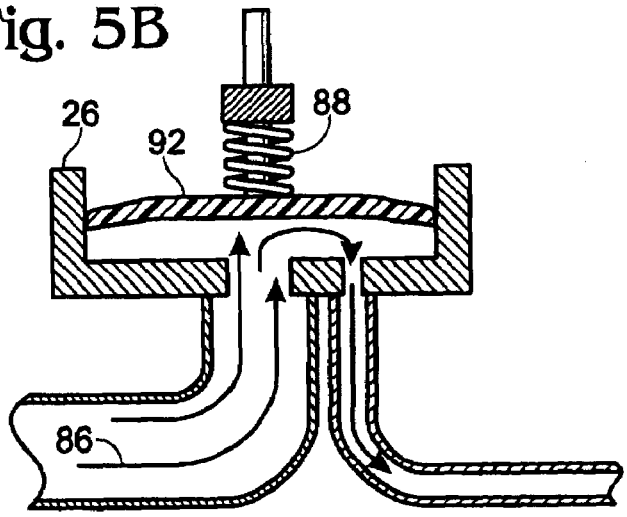

FIGS. 5A and 5B are schematic views of another embodiment of a passive valve 26 in the closed and open positions, respectively. In this embodiment, valve 26 includes a spring 88 loaded diaphram 92 that closes under pressure from a backward flow 84 (FIG. 4A) and opens in response to a forward flow 86 (FIG. 4B). In this embodiment, diaphram 92 may deformed by the pressure of forward flow 86. Accordingly, a relatively high forward flow pressure may be utilized to open diaphram 92. In this embodiment, valve 26 may be open to the atmosphere at spring 88.

Other variations and modifications of the concepts described herein may be utilized and fall within the scope of the claims below.

I claim:

1. An imaging device, comprising:

a printhead;

a first imaging fluid reservoir connected to a first passive one-way valve;

a second imaging fluid reservoir connected to a second passive one-way valve; and a pumping system operatively connected to said first and second imaging fluid reservoirs for selectively flowing imaging fluid from the first imaging fluid reservoir directly to said printhead and from the second imaging fluid reservoir directly to said printhead.

2. The imaging device of claim 1 wherein said first and second imaging fluid reservoirs are each removable from said imaging device.

3. The imaging device of claim 1 wherein said imaging device comprises a printer.

4. The imaging device of claim 1 wherein said pumping system comprises a first pump connected to said first imaging fluid reservoir and a second pump connected to said second imaging fluid reservoir.

5. The imaging device of claim 1 wherein said first and second passive one-way valves each comprise a check valve.

6. The imaging device of claim 1 wherein said pumping system comprises a pump connected to each of said first and second imaging fluid reservoirs, and a manifold that selectively directs pumping action of said pump to one of said first and second imaging fluid reservoirs.

7. The imaging device of claim 6 further comprising a first imaging fluid sensor that senses an imaging fluid level in said first imaging fluid reservoir and a second imaging fluid sensor that senses an imaging fluid level in said second imaging fluid reservoir, said first and second imaging fluid sensors connected to said manifold.

8. The imaging device of claim 1 wherein when said first passive one-way valve is open said second passive one-way valve is closed, and when said second passive one-way valve is open said first passive one-way valve is closed.

9. An imaging device, comprising:

an image producing structure;

at least two imaging fluid reservoirs;

at least two passive one-way valves, each operatively connected to a corresponding one Of said at least two imaging fluid reservoirs; and a pump system connected to said at least two imaging fluid reservoirs wherein operation of said pump system pumps fluid from a first of said two imaging fluid reservoirs directly to said image producing structure and pumps fluid from a second of said two imaging fluid reservoirs directly to said image producing structure.

10. The device of claim 9 wherein said pump system comprises at least two pumps, each operatively connected to one of said at least two imaging fluid reservoirs.

11. The device of claim 9 wherein said at least two imaging fluid reservoirs are each removable from said imaging device.

12. The device of claim 9 wherein each of said at least two passive one-way valves restricts flow into its corresponding imaging fluid reservoir.

13. The device of claim 9 wherein said pump system comprises a pump operatively connected to each of said at least two imaging fluid reservoirs.

14. The device of claim 9 wherein said at least two passive one-way valves includes a first passive one-way valve and a second passive one-way valve, and wherein when said first passive one-way valve is open said second passive one-way valve is closed, and when said second passive one-way valve is open said first passive one-way valve is closed.

15. The imaging device of claim 9 wherein operation of said pump system in a first direction pumps fluid from said first of said two imaging fluid reservoirs directly to said image producing structure and wherein operation of said pump system in a second direction pumps fluid from said second of said two imaging fluid reservoirs directly to said image producing structure.

16. An imaging device, comprising:

a first imaging fluid reservoir connected to a first one-way valve, wherein said first one-way valve is moved between an open position and a closed position solely by fluid flow conditions within said device;

a second imaging fluid reservoir connected to a second one-way valve, wherein said second one-way valve is moved between an open position and a closed position solely by fluid flow conditions within said device; and a pumping system operatively connected to said first and second imaging fluid reservoirs for selectively flowing imaging fluid from each of the first and second imaging fluid reservoirs, wherein said pumping system comprises a first pump connected to said first imaging fluid reservoir and a second pump connected to said second imaging fluid reservoir.

17. The imaging device of claim 16 wherein said first and second imaging fluid reservoirs are each removable from said imaging device.

18. The imaging device of claim 16 wherein said imaging device comprises a printer.

19. The imaging device of claim 16 wherein said first and second one-way valves each comprise a check valve operated in an absence of a valve controller.

* * * * *